US005186252A

United States Patent [19]

Nishizawa et al.

[11] Patent Number: 5,186,252

[45] Date of Patent: Feb. 16, 1993

[54] HEAT TRANSMISSION TUBE

[75] Inventors: Takeshi Nishizawa; Kazuhiko Ooba, both of Tokyo, Japan

[73] Assignee: Furukawa Electric Co., Ltd., Tokyo, Japan

[21] Appl. No.: 819,242

[22] Filed: Jan. 13, 1992

[30] Foreign Application Priority Data

Jan. 14, 1991 [JP] Japan ..... 3-14857

[51] Int. Cl.[5] ..... F28F 1/36

[52] U.S. Cl. ..... 165/181; 165/133; 165/184

[58] Field of Search ..... 165/133, 179, 184, 181

[56] References Cited

U.S. PATENT DOCUMENTS

| | | | |
|---|---|---|---|
| 3,326,283 | 6/1967 | Ware | 165/184 |
| 4,074,753 | 2/1978 | Schmittle et al. | 165/184 |
| 4,216,826 | 8/1980 | Fujikake | 165/133 |
| 4,313,248 | 2/1982 | Fujikake | 29/890.051 |
| 4,549,606 | 10/1985 | Sato et al. | 165/184 |
| 4,715,433 | 12/1987 | Schwarz et al. | 165/110 |
| 4,733,698 | 3/1988 | Sato | 165/179 |
| 4,796,693 | 1/1989 | Kastner et al. | 165/184 |

FOREIGN PATENT DOCUMENTS

| | | | |
|---|---|---|---|
| 0222100 | 5/1987 | European Pat. Off. . | |
| 0305632A1 | 3/1989 | European Pat. Off. . | |
| 11465 | 1/1977 | Japan | 165/133 |
| 57-131992 | 11/1977 | Japan . | |
| 93190 | 5/1984 | Japan | 165/181 |
| 1384912 | 3/1988 | U.S.S.R. | 165/181 |

*Primary Examiner*—John Rivell
*Assistant Examiner*—L. R. Leo
*Attorney, Agent, or Firm*—Armstrong, Westerman, Hattori, McLeland, & Naughton

[57] ABSTRACT

According to the invention, there is provided a heat transmission tube having a tube body, first grooves formed at a predetermined pitch therebetween on an outer surface of the tube body continuously along a circumferential direction, the first grooves open to an outside, and having an opening portion, a width of which is narrower than that of a bottom portion thereof, and second grooves formed at a predetermined pitch therebetween on the outer surface of tube body continuously along an axial direction, the second grooves having a depth shallower than that of the first grooves, and connecting opening portions of the adjacent first grooves to each other, wherein a projecting member is provided on a bottom surface of each of the first grooves so as to connect a side wall of each of the first grooves to another is brought into contact with the tube body. This heat transmission tube exhibits a high and stable heat transmissibility in both high and low heat flux cases.

7 Claims, 5 Drawing Sheets

HEAT TRANSMISSION TUBE

BACKGROUND OF THE INVENTION

1. Field of the Invention

The present invention relates to a heat transmission tube, and more specifically to that built in an evaporator of a freezer, a coolant being boiled at the outer surface of which when the tube is used.

2. Description of the Related Art

The heat transmission tube disclosed in Published Unexamined Japanese Patent Application (PUJPA) No. 57-131992 (Japanese Patent Application No. 56-211772) can be named as a typical conventional tube which boils coolant brought into contact with the outer surface thereof through exchange of heat between the coolant and fluid in the tube, so as to enhance transmission of heat propagated on to coolant (to be called boiling heat transmission hereinafter). Such a heat transmission tube is characterized by having a first and second groove portion formed on the outer surface of the low-fin tube by a roll forming process. This type of heat transmission tube is used in a liquid or gaseous coolant. This tube exhibits a good property in terms of heat transmission rate since, in the tube, bubbles remaining in the groove make boiling continue, thereby increasing the amount of heat transmission. Thus, a high transmissibility can be achieved.

However, such a tube has a disadvantage of very poor boiling heat transmission in a case of low heat flux. In consideration of this problem, there has been a great proposal for a heat transmission tube which exhibits a high heat transmissibility in a low heat flux case, which leads to efficient use of a heat source of a low temperature.

In the meantime, a device in which the heat transmission tube is built, is used with various loads in accordance with necessity; therefore it is required that the tube exhibit a high and stable transmissibility not only in a high heat flux case but also in a low one.

SUMMARY OF THE INVENTION

The purpose of the invention is to provide a heat transmission tube which exhibits a high and stable heat transmissibility in both cases of low and high heat fluxes.

This purpose can be achieved by a heat transmission tube having a tube body, first grooves formed at a predetermined pitch therebetween on an outer surface of the tube body continuously along a circumferential direction, the first grooves open to an outside, and having an opening space, a width of which is narrower than that of a bottom space thereof, and second grooves formed at a predetermined pitch therebetween on the outer surface of the tube body continuously along an axial direction, the second grooves having a depth shallower than that of the first grooves, and connecting opening spaces of adjacent first grooves to each other, wherein a projecting member is provided on a bottom surface of each of the first grooves so as to connect a side wall of each of the first grooves to another.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be explained in detail with reference to accompanying drawings.

Figure 1:
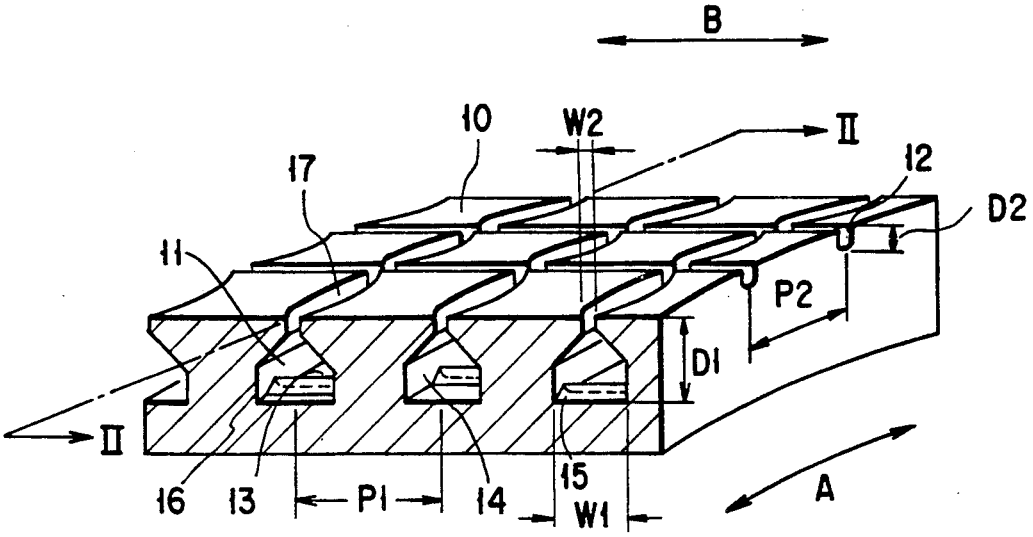
FIG. 1 is a perspective view of a part of a heat transmission tube according an embodiment of the present invention.

FIG. 1 is a partial perspective view of a heat transmission tube according to an embodiment of the present invention. This figure shows a part of a tube body 10, in which fluid, i.e. water, coolant such as Freon, or vapor thereof, flows. On the outer surface of the tube body 10, formed are continuous first grooves 11 along the circumferential direction (indicated by letter A in the figure) of the tube body 10. Formation of the outer surface creates a plurality of fins on the outer surface of the tube body 10. Further, continuous second grooves 12 are formed also on the outer surface of the tube body 10 along the axial direction thereof (indicated by letter B in the figure). On the bottom surface 13 of each of the first grooves 11, formed is a projecting member 15 for connecting a side wall 14 of one of the first grooves 11 to the same of another.

Meanwhile, some of the examples of the raw materials for the tube body 10 are copper, steel, titanium, aluminum, and an alloy thereof.

Each of the first grooves 11 has a bottom portion 16 a width $W_1$ of which is relatively wide, and an opening portion 17 a width $W_2$ of which is relatively narrow. The ratio of the width of the bottom portion 16 to that of the opening portion 17 ($W_1/W_2$) should preferably be in the range between 1 and 12 in consideration of follow-up for capturing and departure of bubbles. A pitch $P_1$ of the first grooves 11, that is, the distance between the centers of adjacent first grooves 11, should preferably be in the range between 0.5 mm and 1.0 mm in consideration of follow-up for capturing of bubbles and the heat transmissibility. The number of the first grooves 11 should preferably be 25–50 per an inch, and they should be formed all the way through the heat transmission tube with an appropriate pitch $P_1$ between each adjacent pair of the grooves. A depth $D_1$ of each of the first grooves 11 should preferably be in the range between 0.2 mm and 1.2 mm in consideration of follow-up for capturing of bubbles and the heat transmissibility. It should be noted here that as long as the groove is formed continuously in the circumferential direction of the tube body 10, the first grooves 11 may be ring-shaped, or spiral.

A pitch $P_2$ of the second grooves 12, that is, the distance between the centers of adjacent second grooves 12, should preferably be in the range between 0.4 mm and 1.5 mm. This is because, if the pitch $P_2$ is out of this range, the opening portion 17 cannot be formed to have desired measurements due to structural limitation. The number of the second grooves 12 should preferably be 25–60 per an inch, and they should be formed all the way through the heat tube with an appropriate pitch $P_2$ between each adjacent pair of the grooves. In order to generate more bubbles, the number of the opening portions 17 and the second grooves should be increased. It should be noted, however, that the number of these portions and grooves is somehow limited by the type of the fluid brought into contact with the outer surface of the tube body.

Figure 2:
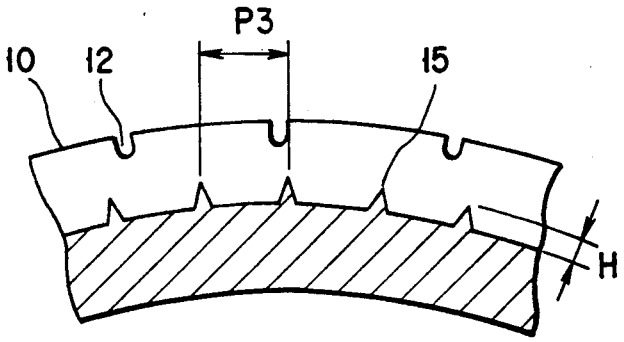
FIG. 2 is a cross section of the tube, taken along the line II—II of FIG. 1.

As can be seen in FIG. 2, a height H of the projecting member 15 should preferably be 2–40% of the depth $D_1$ of the first grooves 11. This is because, if the height H is less than 2% of the depth $D_1$, the heat transmission tube cannot exhibit its full heat transmissibility in a low heat flux region, and if the height H exceeds 40% of the depth $D_1$, supply of the coolant to the outer surface of the tube body is significantly reduced in a high heat flux region. Most preferably, the height H should be 10–40% of the depth $D_1$. Further, as shown in FIG. 2, a pitch $P_3$ of the projecting members 15, that is, the distance between the tip ends of adjacent projecting members should preferably be in the range between 0.5–4.5 mm. This is because, if the pitch $P_3$ is less than 0.5 mm, movement of the coolant in the first grooves is suppressed too much, and if it exceeds 4.5 mm, the heat transmission area is reduced, deteriorating the effect of suppressing the movement of the coolant. The shape of the cross section of the projecting member 15 is not particularly specified here, and may be, for example, polygonal such as triangular, semicircular, or trapezoidal.

Thus, the heat transmission tube has such a structure that a projecting member 15 is formed on the bottom of each of the first grooves 11; therefore the area of the outer surface, which is called heat transmission area, with which the coolant is brought into contact, is larger than that without any projecting member. Thus, generation of bubbles from each of the first grooves 15 is enhanced, and a thin-film-maintaining effect can be thus observed at the tip end portion of each of the projecting members during boiling. Further, each of the projecting members 15 serves to divide the bottom space of each of the first grooves 11 into small regions; therefore it becomes possible to suppress movement of the coolant at each proximal fin, that is, the bottom space of each of the first grooves.

As described, in the heat transmission tube of the present invention, coolant can be easily boiled by regional heating of the outer surface of the tube body; therefore the tube can exhibit a high heat transmissibility improved especially in a low heat flux region.

The following is an explanation of an embodiment carried out in connection with the present invention.

Figure 3:
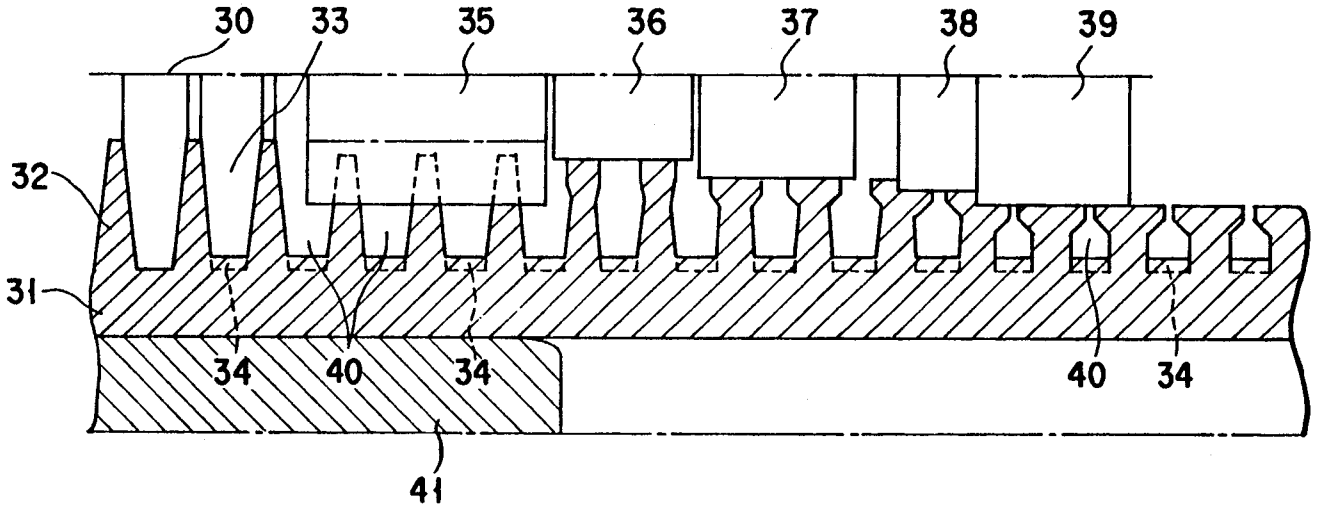
FIG. 3 is a diagram illustrating a method of manufacturing the heat transmission tube of the present invention.
Figure 4:
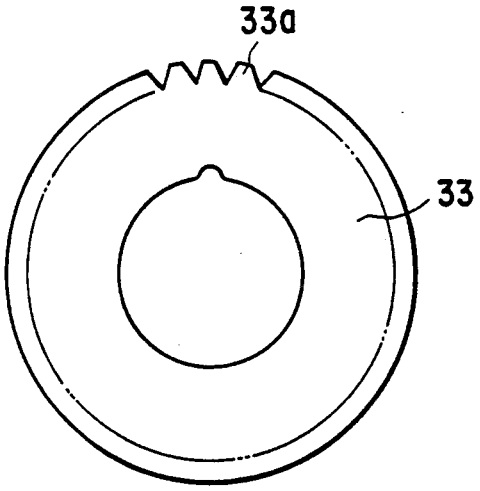
FIG. 4 is a diagram of a molding disk used for manufacturing a heat transmission tube of the invention.

A copper tube having the external diameter of 19.05 mm and the thickness of 1.24 mm, is subjected to a process with a disk 30 for formation of fins, disk 33 for formation of projecting members, tool 35 for formation of a second grooves, and rolling tools 36–39, as can be seen in FIG. 3. The process of the tube body 31 is held by mandrel 41 in the tube and carried out starting from the state shown on the left-hand side of the figure toward the right-hand side. As the fin-formation disk 30 is rotated, the outer surface of the tube body 31 is formed into fins 32, and a projecting member 34 is formed on the bottom portion of each of the first grooves 40, each defined by adjacent fins 32, by means of a formation disk 33, on a part of the circumference of which teeth **33*a* are formed as shown in FIG. 4. Then, using tool 35 for formation of a second grooves and rolling tools 36–39, the tip of each of the fins 32 is gradually pressed to have thick head portion shown in the figure, and the second grooves are formed on the tube body 31 along the axial direction thereof by use of the rolling tube 35**, in particular. Thus, manufacture of a heat transmission tube of the invention is completed.

The tube thus obtained has forty of the first grooves 40 formed on each one-inch portion of the outer surface of the tube body 31 along the circumferential direction, a projecting member 34 formed on the bottom of each of the first grooves 40 along a direction substantially parallel to the axial direction of the tube body 31 such that the member 34 connect the fins 32 on both sides thereof to each other, and eighty of the second grooves formed also on the outer surface of the tube body along the axial direction thereof. Each of each of the first grooves has the following measurements; the width of the bottom portion of 0.3 mm, the width of the opening portion of 0.1 mm, and the depth of 0.7 mm. The pitch of the first grooves is 0.64 mm. The pitch of the second grooves is 0.75 mm. The height of the projecting members is 15% of the depth of the first grooves. The pitch of the tip portions of the projecting members is 1.5 mm, and the cross section of each of the projecting members is essentially triangular.

Figure 5:
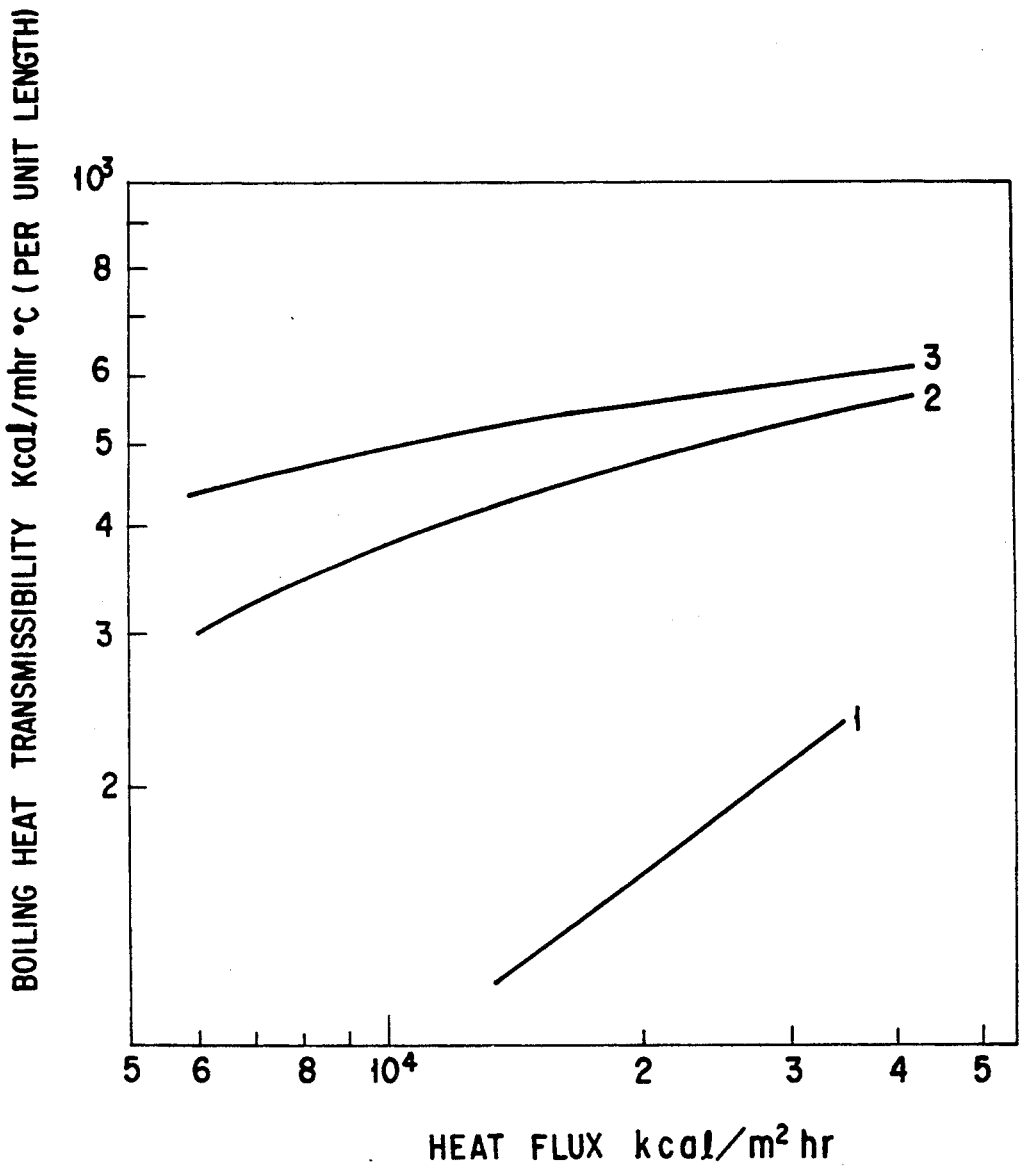
FIG. 5 is a graph showing a correlation between the boiling heat transmissibility and heat flux of the tube.

FIG. 5 shows the boiling heat transmissibility (defined by the amount of heat transmitted, per unit length, unit time, and unit temperature) exhibited from a low heat flux region to a high heat flux region of each of the heat transmission tube of the present invention (characteristic curve 3), a conventional heat transmission tube with first and second grooves and without projecting members (curve 2), and a conventional heat transmission tube with low fin (26 per inch) (curve 1). As is clear from this figure, the heat transmission tube of the present invention exhibits a high boiling heat transmissibility in both low and high heat flux regions. Especially, in the low heat flux region, the transmissibility of the tube of the invention is 20% higher than that of the conventional tube (curve 2).

Figure 6B:
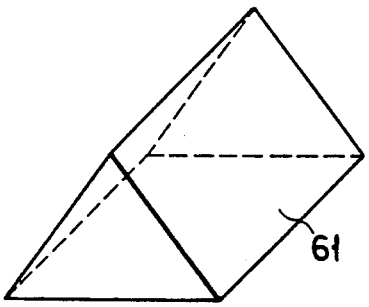
FIGS. 6A–6C are perspective views of several types of the projecting member of the heat transmission tube of the present invention.
Figure 6A:
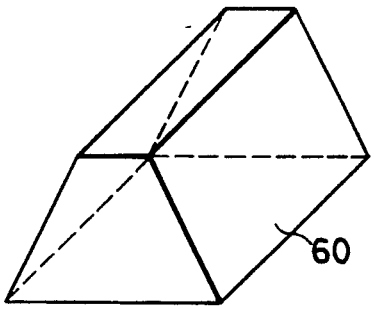
Figure 6C:
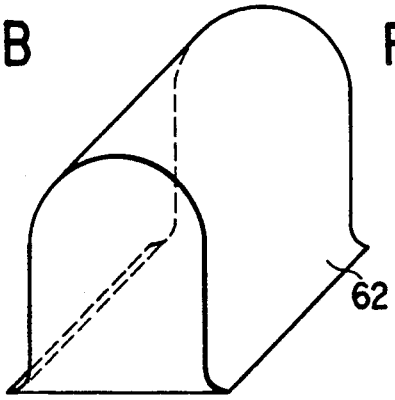

In this embodiment, the projecting members 60 are formed such that the cross section thereof has a triangular shape as shown in FIG. 6B, but the shape of the cross section may be trapezoidal or semicircular as shown in FIGS. 6A and 6C, without degrading the advantage of the invention.

Figure 7:
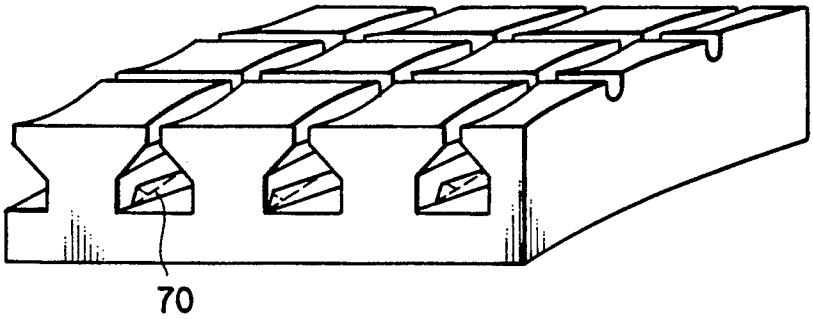
FIG. 7 is a diagram showing a perspective view of the main portion of a heat transmission tube according to another embodiment of the invention.
Figure 8:
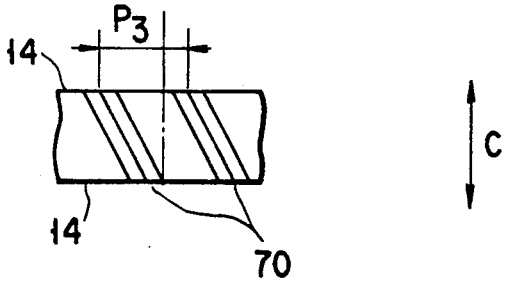
FIG. 8 illustrates a direction to which the projecting member is inclined, and the axial direction C of the tube body.

Further, the projecting members 60 are formed along a direction substantially parallel to the axial direction of the tube body, but as long as the projecting members connect both side walls of each of the first grooves to each other, they may be formed such that the longitudinal direction of the projecting members 70 is tilted with respect to the axial direction (direction C in FIG. 8) of the tube body by a predetermined angle less than 60° as can be seen in FIGS. 7 and 8.

To summarize, the heat transmission tube of the present invention has a high and stable heat transmissibility in both cases of low and high heat fluxes.

Lastly, heat exchangers in which the heat transmission tube of the present invention is employed have advantages in terms of miniaturization of the device, as well as performance.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A heat transmission tube comprising:

a tube body;

first grooves formed at a predetermined pitch therebetween on an outer surface of said tube body continuously along a circumferential direction, said first grooves open to an outside, and having an opening portion, a width of which is narrower than that of a bottom space thereof;

second grooves formed at a predetermined pitch therebetween on said outer surface of said tube body continuously along an axial direction, said second grooves having a depth shallower than that of said first grooves, and connecting opening portions of adjacent first grooves to each other; and a plurality of projecting members extending from a bottom surface of each of said first grooves and connecting at least a side wall of each of said first grooves to another.

2. A heat transmission tube according to claim 1, wherein said tube body is made of a material selected from the group consisting of copper, steel, titanium, aluminum, and an alloy thereof.

3. A heat transmission tube according to claim 1, wherein a height of said projecting members is 2–40% of the depth of said first grooves.

4. A heat transmission tube according to claim 1, wherein a pitch between adjacent projecting members is the range between 0.5 mm and 4.5 mm.

5. A heat transmission tube according to claim 1, wherein a longitudinal direction of at least one of said projecting members is in substantially parallel with the axial direction of the tube body.

6. A heat transmission tube according to claim 1, wherein a longitudinal direction of at least one said projecting members is tilted with respect to the axial direction of the tube body by a predetermined angle.

7. A heat transmission tube according to claim 6, wherein said predetermined angle is less than 60 degrees.

* * * * *